United States Patent [19]

Nordbak

[11] 4,040,775

[45] Aug. 9, 1977

[54] APPARATUS FOR MAKING A PRESTRESSED CONCRETE SLAB

[76] Inventor: John A. Nordbak, 10919 Lakewood Blvd., Downey, Calif. 90241

[21] Appl. No.: 617,712

[22] Filed: Sept. 29, 1975

[51] Int. Cl.[2] ..... B28B 23/06

[52] U.S. Cl. ..... 425/111; 264/228

[58] Field of Search ..... 425/111; 264/228–229; 254/51; 403/102

[56] References Cited

U.S. PATENT DOCUMENTS

| | | | |
|---|---|---|---|
| 3,181,222 | 5/1965 | Palmer | 425/111 |
| 3,202,394 | 8/1965 | Shoe | 425/111 |
| 3,215,403 | 11/1965 | Bauder | 254/51 |
| 3,475,529 | 10/1969 | Lacy | 264/228 |
| 3,563,592 | 2/1971 | Preston | 403/102 |
| 3,938,922 | 2/1976 | Godley | 425/111 |

FOREIGN PATENT DOCUMENTS

| | | | |
|---|---|---|---|
| 142,009 | 3/1960 | U.S.S.R. | 425/111 |

*Primary Examiner*—Robert L. Spicer, Jr.

*Assistant Examiner*—John McQuade

*Attorney, Agent, or Firm*—George J. Netter

[57] ABSTRACT

A plurality of cables to be prestressed and made a part of the final concrete slab, each have their ends secured within a plate with the overall arrangement of wires or cables being of a geometry substantially that of the desired final structural unit. A pair of lever bars pivotally related at their ends are connected to the plates such that when pivoted into straight line relation, the plate securing the ends of the cables are separated from one another, placing the wires in tension. The entire set of stressed cables and lever bars is lifted as a unit and placed onto a horizontal surface having upstanding means received through openings in the plates. Adjustment screws secure the plates to the upstanding means on the horizontal surface, after which the lever bars are removed. Concrete is poured over the tension cables, forming the structural slab, after which on setting up, the end plates are removed from the wires, leaving the prestressed concrete slab with implanted tension wires.

4 Claims, 12 Drawing Figures

FIG. 9.
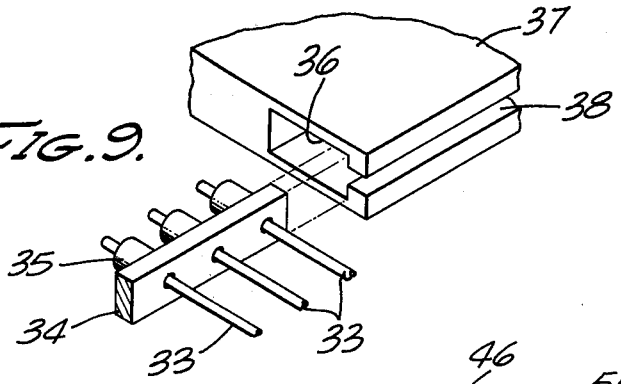
FIG. 10.
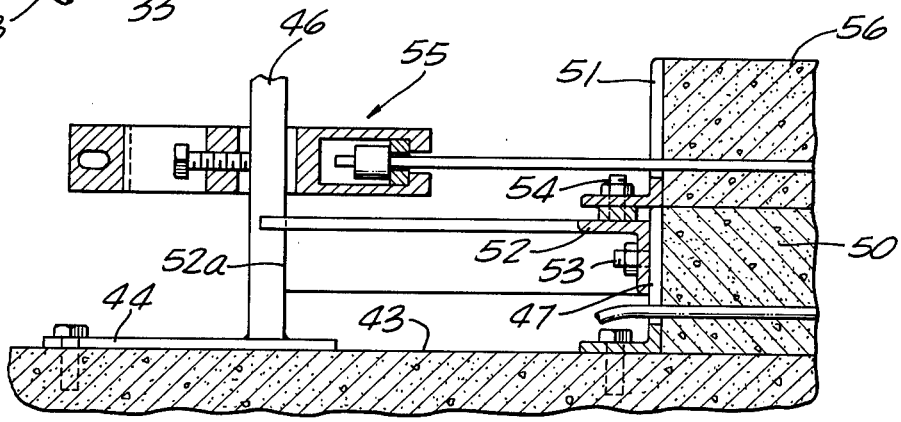
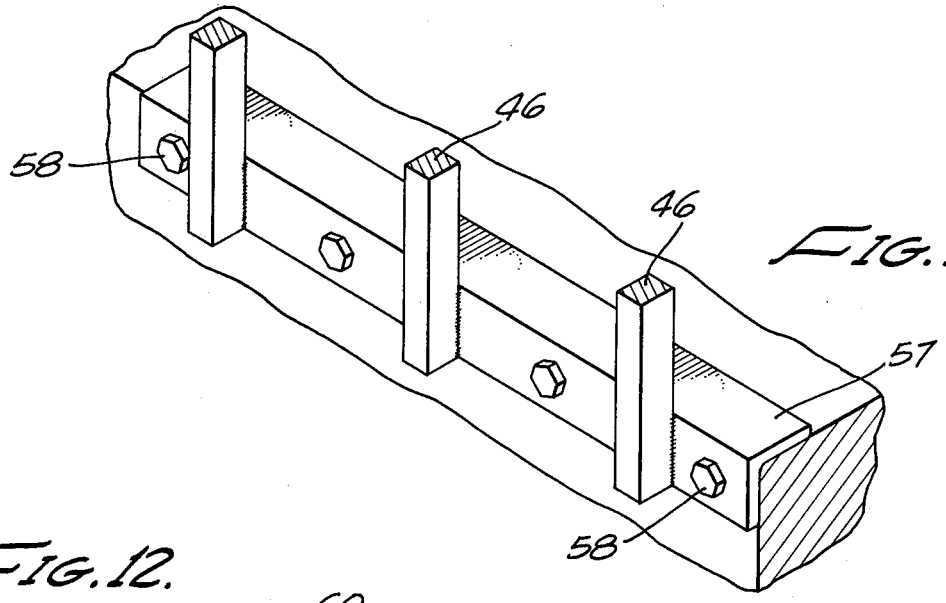
FIG. 11.
FIG. 12.
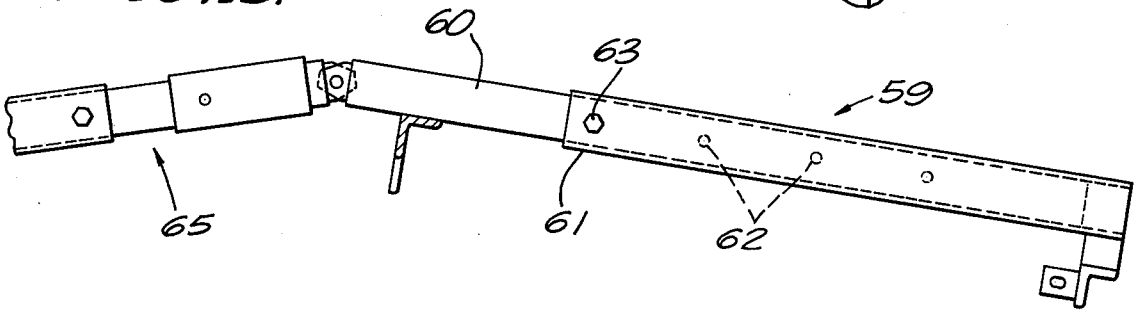

APPARATUS FOR MAKING A PRESTRESSED CONCRETE SLAB

The present invention relates generally to prestressed concrete slabs or structural units, and, more particularly, to apparatus for producing such slabs or structural units on site.

BACKGROUND OF THE INVENTION

It is known that a concrete structural unit which is held in compression is capable of withstanding larger tensile and bending stresses than it can in an unstressed condition. Accordingly, in the past it has been standard practice to include within a concrete structural unit or slab elongated metal elements which are placed in tension prior to the pouring of the concrete. On setting up, the metal elements are maintained in tension due to a bond between the concrete and the elements, which, in turn, imparts a certain amount of compression to the concrete.

Since concrete structural panels are rather heavy and difficult to transport, it is desirable to fabricate the panels as close as possible to their point of final use. In the past, there have been devised various on-site techniques and apparatus for producing prestressed concrete slabs for structural units, however, all of these have been subject to one or more deficiencies such as either the need for complex and expensive apparatus, the processes were difficult to put into practice, or there was a requirement for highly skilled individuals to carry them out.

SUMMARY OF THE INVENTION

In the practice of this invention, a plurality of wires or cables, which are to be prestressed and made a part of the final concrete slab, each have their ends secured within a plate with the overall arrangement of wires or cables being of a geometry substantially that of the desired final structural unit. A tensioning means, consisting of a pair of lever bars pivotally related at their ends, are connected to the plates and has an overall length such that when pivoted into straight line relation, the plate securing the ends of the wires or cables are separated from one another, placing the wires in tension. The entire set of stressed wires or elements, including the tensioning means is then lifted as a unit and placed onto a horizontal surface having upstanding means which are received through accomodating openings in the plates holding the wires. Adjustment screws secure the plates to the upstanding means on the horizontal surface after which the tensioning means is then removed. Concrete is poured over the tensioned wires or cables, forming the structural slab in the normal way, after which on setting up, the end plates are removed from the wires, leaving the prestressed concrete slab with implanted tension wires.

In an alternate version, the upstanding means on the table are such as to accommodate a plurality of slabs, stacked one on the other.

DESCRIPTION OF THE DRAWING

FIG. 9 shows the wire end securing means.

FIG. 10 is an elevational, sectional view, partially fragmentary, of the work table mounting posts of an alternate version of the invention.

FIG. 11 is a perspective, partially fragmentary view of an alternate post arrangement on the work table.

FIG. 12 depicts a further form of tensioning lever apparatus adjustable to various lengths.

DESCRIPTION OF PREFERRED EMBODIMENTS

Figures 1, 2, 3, 4:
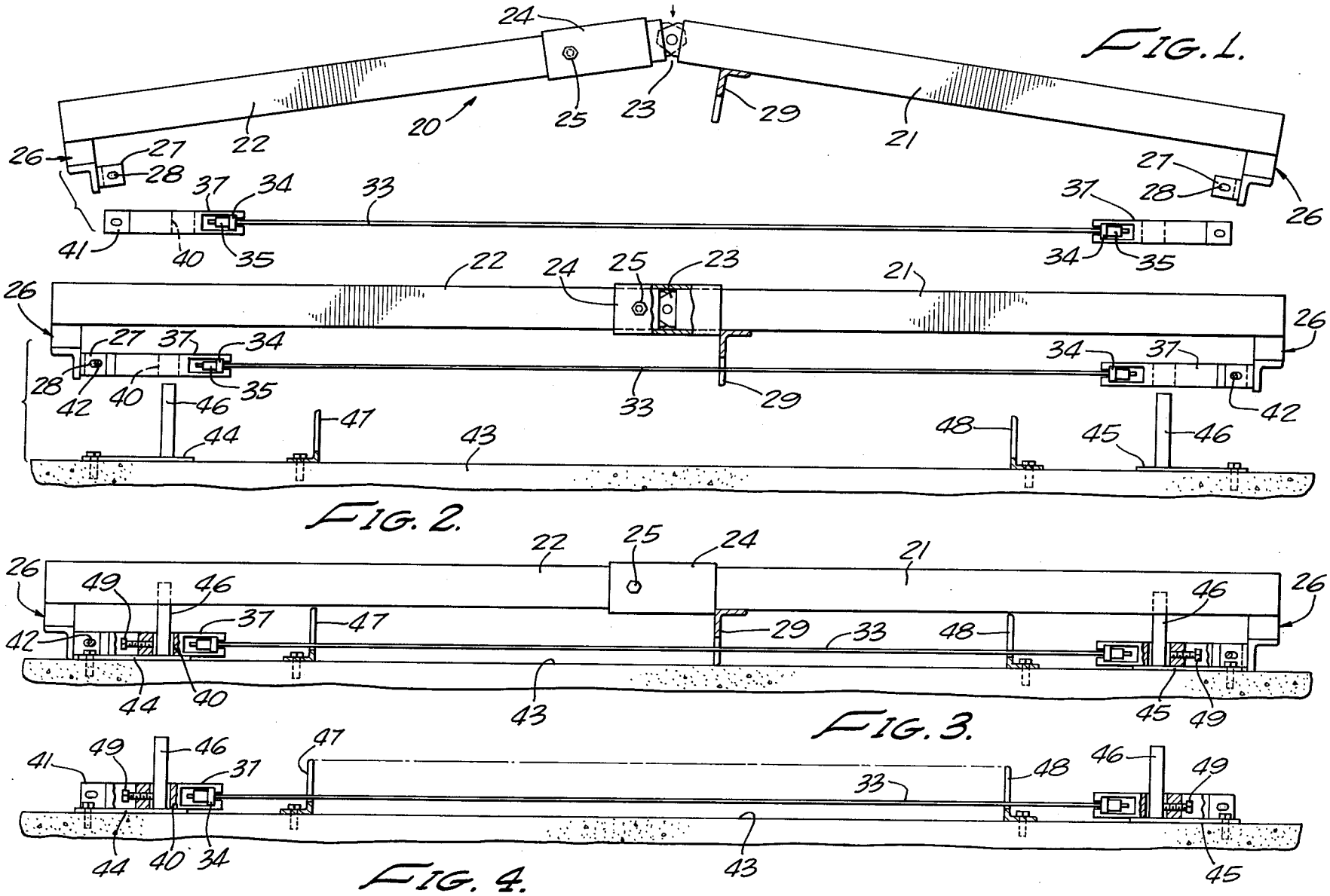
FIG. 1 is a side elevational view of the tension bar shown prior to its engagement with a set of wires to be placed in tension.
FIG. 2 shows wires placed in tension by the apparatus of this invention and during lowering into position on a work table prior to pouring concrete thereon.
FIG. 3 is an elevational view showing the tensioned wires in place on the work table.
FIG. 4 is an elevational view similar to FIG. 3 with the tensioning lever apparatus removed.

With reference now to the drawings and particularly to FIG. 1, the tensioning lever apparatus 20 is seen to include a pair of elongated bars 21 and 22, of substantially the same length, which are pivotally joined together at one end of each as at 23. A sleeve 24 is slidably carried on the bar 22 and can be adjusted to slide over the pivot 23 and secure the two bars together into a stratight line relationship as shown in FIG. 2, for a purpose to be described. The sleeve may be secured in place at a desired position by a suitable adjustment of a threaded member 25 which passes through the sleeve for engagement with the surface of either of the bars 21 or 22.

The outer end portion of each of the lever bars 21 and 22 has a connection member 26 which extends away from the two bars in the same direction and further includes a bifurcated member or yoke 27 with an elongated opening 28 in the arms thereof.

The bar 21 includes an L-shaped channel iron 29 located at a point spaced from the pivotal end and extending away from the bar in the same direction as the connection member 26. This channel iron serves both as a pedestal for the central portion of the levering system and as a limit stop for the sleeve 24 as it moves onto the bar 21 (FIG. 2).

Figure 5:
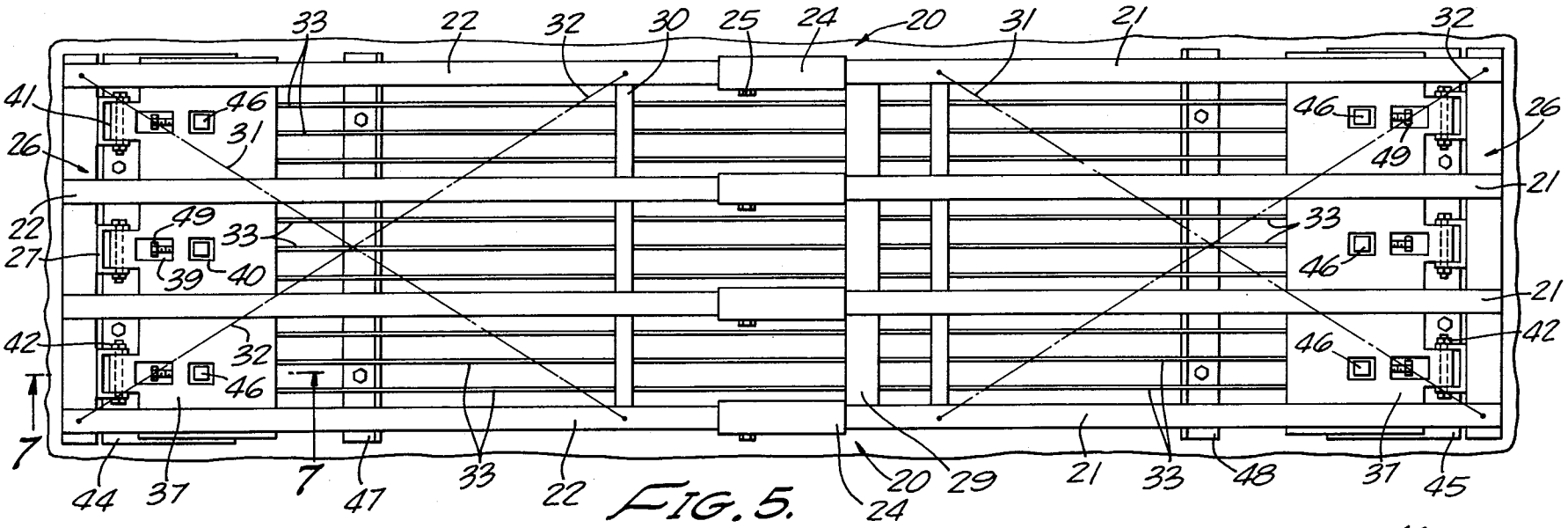
FIG. 5 is a top plan view of a set of wires in tension on a table prior to the removal of the tensioning lever apparatus and pouring of concrete.
Figure 7:
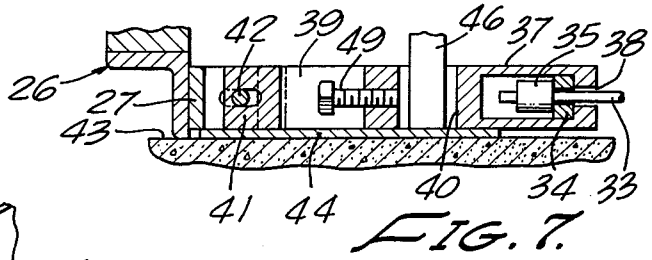
FIG. 7 is a sectional view taken along the line 7—7 of FIG. 5.
Figure 8:
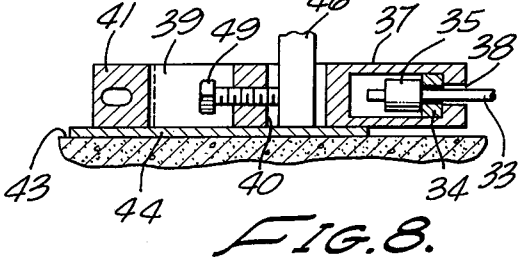
FIG. 8 is a view similar to FIG. 7, showing an adjustment of the apparatus for maintaining tension on the wires.

As can be seen best in FIG. 5, a plurality of tensioning lever bar apparatus 20 are used for producing a panel, the exact number of which would depend upon the size and shape of the panel desired. Specifically, one tensioning bar apparatus 20 for each 3–5 wires to be tensioned is advisable. The tensioning lever bar apparatus have a common structural member 30, which extends transversely of each of the component bars 22 and is interconnected therewith at a point substantially spaced from the sleeve 24. Also, the interconnection member 26 includes a channel that interconnects with the outer end of each of the bars 21 and serves as a reinforcing member for the entire set of lever bars. It is also advisable to utilize diagonally extending struts 31 and 32 to maintain the rectangular configuration as seen in plan. Accordingly, as shown in FIG. 5, the apparatus to be described herein will be considered to include four sets of tensioning lever bar apparatus 20, operated in common to apply the desired amount of tension to the wires or rods 33 in a manner to be described.

In the usual case the wires or rods 33 may be either multi-strand or solid wire cable or metal rods, although for simplicity they will be referred to hereinafter as "wires".

In preparation for practice of the subject invention, these wires have their end portions received through respective openings in an elongated bar 34 which holds them uniformly laterally spaced. A bushing 35 is received onto the end portion of each wire extending through the bar 34 and is crimped to secure it in place and prevent withdrawal of the wire (FIG. 9). The bar with included wires 33 is then slid into an appropriately formed opening 36 in an end plate 37, with the individual wires extending outwardly through a slot formed in an edge of the plate 37. More particularly, the plate 37 is of generally rectangular, flat construction with the opening 36 extending from one side wall through the opposite side wall. The slot 38 is large enough to permit the wires 33 to pass therethrough, but at the same time retain the bar 34.

Figure 6:
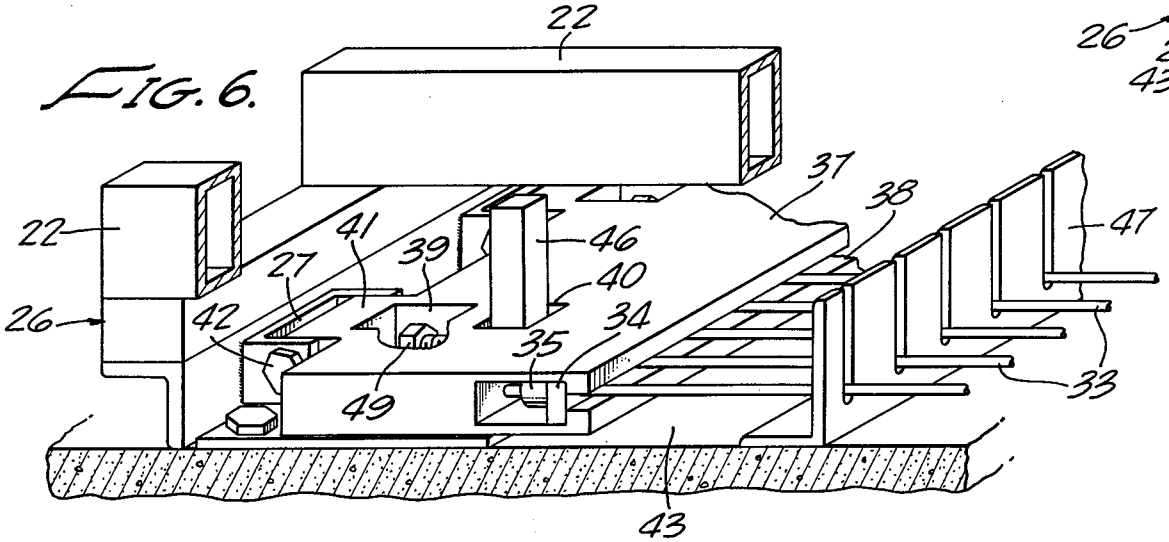
FIG. 6 is an enlarged, perspective, partially fragmentary view of an end plate for holding wires during tensioning and shown in place on a work table prior to pouring of concrete.

Turning now to FIG. 6, the end plate 37 is seen also to include enlarged generally rectangular openings 39 and 40, passing through the plate major surfaces for a purpose to be described later. On the edge of the plate 37, opposite that containing the slot 38, there are provided extensions 41, each with an opening passing therethrough for receiving a threaded member or bolt 42 to secure ends of bars 21 and 22 therein.

In practicing the method of using the apparatus of this invention, with the desired number of wires 33 having their ends received in the bar 34 and each bar 34, in turn, received in an end plate 37, the entire set of wires is now ready for stressing. The connection means 26 is now received onto the end plates 37 such that the bifurcated members 27 are received on the extensions 41, and bolts, studs or other such member 42 secure the outer ends of bars 21 and 22 to the respective plates. A downward force is then applied to the bars in the region of the pivot 23 as shown by the arrow, which causes the two bars to assume a generally straight line configuration as shown in FIG. 2 and which at the same time extends the wires 33, placing them in tension. To maintain this condition, the sleeve 24 is slid over the pivot region 23, thereby securing the ends of 21 and 22 together. Tightening of the threaded member 25 maintains the sleeve in position and prevents inadvertent release of tension on the wires.

The work table or surface 43 has a horizontal upper surface to which there are affixed a pair of plates 44 and 45 with a plurality of upstanding posts 46 thereon. The plates and posts are so arranged and of such geometry as to permit the entire framework of wires 33 secured within end plates 37 and tensioned as described, being lowered onto the work table and the posts 46 received through respective openings 40 of the end plate 37. A pair of comb separators 47 and 48, mounted on the work table, receive the wires in their notches (FIG. 6) to provide a batter/screed against which concrete is poured.

With the entire framework of wires and tensioning apparatus positioned on the work table as in FIG. 3, threaded members 49 are advanced until they engage posts 46 as shown in FIG. 4, at which time all of the lever bar tensioning apparatus 20 are removed. Since the threaded members 49 are in contact with the posts 46, the wires are still maintained in tension after removal of apparatus 20.

The suitably tensioned wires are now securely mounted to the work table and spaced above the table surface. Suitable forms are located about the work table and concrete poured in the region between the combs 47 of the desired geometry for the reinforced slab. On the concrete setting up, the tensioned wires are securely held within the so-formed slab. After backing off the threaded members 49, the end plates may be removed and the ends of the wires including the bushings cut off. The slab is now ready for use.

FIG. 10 depicts a further version of the invention pemitting fabrication of several slabs on the same work table without having to remove the first fabricated slab/s. With a first slab 50 constructed in the manner described and the associated end plates removed, a second comb 51 is mounted onto the top of comb 47 (and similarly for the comb 48, not shown) with interconnection and support provided by the L-shaped member 52. More particularly, the L-shaped member 52 is secured to the post 46 as at **52*a* and has one leg secured to the comb 47 by threaded member 53 and the other leg to the comb 51 base by threaded means 54. A further set of tensioned wires and associated end plates depicted generally as at 55 are then positioned on top of the first laid slab 50. In addition, the posts 46 must be sufficiently long to accommodate the required number of end plates 37. Otherwise, fabrication of the second slab 56 is the same as the first slab 50**.

An alternative way of mounting the posts 46 to the work table 43 is shown in FIG. 11. As shown there, the posts 46 are all welded or otherwise suitably affixed to the same outside surface of an L-shaped channel 57, which, in turn, is fitted over the corner edge of the work table and secured thereto by threaded members.

It can be well appreciated that reinforced slabs constructed in accordance with this invention can be made in a variety of lengths and widths. Reference is now made to FIG. 12 where a lever bar means is shown which can be adjusted for making slabs of several different lengths. Thus, instead of being made in one piece as the lever bar 21, lever bar 59 includes a first bar 60 slidingly received within a sleeve 61. The bar 60 has a plurality of transverse openings 62 therein which can be adjustably located in alignment with an opening adjacent the inner end of the sleeve 61 and secured therewith by a bolt 63. In this manner, the bar 59 and similarly its companion bar 65, can be adapted for different lengths of slabs. Otherwise, the construction and use are identical to that already described.

I claim:

1. Apparatus for producing and maintaining a set of generally parallel wires in tension while enclosing them in a concrete slab, comprising:

first and second platelike means for being affixed to the opposite ends of said wires, respectively, each said platelike means including a plate having an opening within which a bar is slidingly received, said bar having openings through which the wire ends are respectively adapted to be received and bushings operatively associated with each bar adapted to be secured onto each wire end and being of dimensions greater than those of the bar openings such that said bushings are unable to pass through the bar openings;

a pair of elongated lever bars having a first end portion of each bar pivotally interconnected together and having their second end portions connected respectively to the first and second platelike means, said lever bars being of such length that when pivoted into straight line relationship the lever bars move the platelike means away from each other placing the wires in tension;

a table having a surface for supporting the tensioned wires, platelike means and lever bars;

means carried by at least one of said lever bars for locking said lever bars in said straight line relationship; and means affixing the platelike means to the table surface to maintain the tension in the wires while the lever bars are disconnected from the platelike means and plastic concrete is deposited onto said wires to form the concrete slab.

2. Apparatus as in claim 1, in which said locking means includes a sleeve received on one of the lever bars and slidable therealong to be received onto a part of the other lever bar when the two bars are arranged in a straight line to maintain said lever bars in said straight line relationship.

3. Apparatus as in claim 1, in which said means affixing the platelike means to the table surface includes an upstanding post passing through an opening in each platelike means.

4. Apparatus as in claim 1, in which there is further provided first and second combs mounted on the table surface at spaced points with the wires adapted to pass through slots in said combs, said combs serving as batter-screeds for the plastic concrete.

* * * * *